US009649251B2

(12) United States Patent
Fossan

(10) Patent No.: US 9,649,251 B2
(45) Date of Patent: May 16, 2017

(54) METHOD AND SYSTEM FOR MEASURING CHEST PARAMETERS, ESPECIALLY DURING CPR

(75) Inventor: Helge Fossan, Stavanger (NO)

(73) Assignee: Laerdal Medical AS, Stavanger (NO)

( * ) Notice: Subject to any disclaimer, the term of this patent is extended or adjusted under 35 U.S.C. 154(b) by 271 days.

(21) Appl. No.: 13/395,928

(22) PCT Filed: Nov. 9, 2010

(86) PCT No.: PCT/EP2010/067095

§ 371 (c)(1),
(2), (4) Date: Mar. 14, 2012

(87) PCT Pub. No.: WO2011/058001

PCT Pub. Date: May 19, 2011

(65) Prior Publication Data

US 2012/0191014 A1 Jul. 26, 2012

(30) Foreign Application Priority Data

Nov. 11, 2009 (NO) ..... 20093315

(51) Int. Cl.
*A61H 31/00* (2006.01)

(52) U.S. Cl.
CPC ..... *A61H 31/005* (2013.01); *A61H 31/004* (2013.01)

(58) Field of Classification Search
CPC ..... A61M 16/0072; A61M 16/0078; A61M 16/01; A61M 16/04; A61M 16/0666; A61M 16/08; A61M 16/0875; A61M 16/1055; A61M 16/12; A61M 16/18; A61M 16/20; A61M 16/208; A61B 3/1233; A61B 5/02007; A61B 5/02028; A61B 5/02416; A61B 5/026; A61B 5/029; A61B 5/046; A61B 5/055
USPC ..... 600/587, 595, 12, 9, 15
See application file for complete search history.

(56) References Cited

U.S. PATENT DOCUMENTS 4,314,251 A * 2/1982 Raab ..... 342/463
6,062,216 A * 5/2000 Corn ..... 128/204.23
6,306,107 B1 10/2001 Myklebust et al.
6,323,942 B1 * 11/2001 Bamji ..... 356/5.01
(Continued)

FOREIGN PATENT DOCUMENTS

CN 101018500 A 8/2007
EP 1057451 A2 12/2000
(Continued)

OTHER PUBLICATIONS

Knoflacher, Nikolaus, "International Search Report" for PCT/EP2010/067095, as mailed Apr. 12, 2011, 3 pages.

*Primary Examiner* — Sean Dougherty
(74) *Attorney, Agent, or Firm* — Winstead PC

(57) ABSTRACT

This invention relates to a system for monitoring the position of a measuring unit when placed on a person, especially on the chest of a person, the system comprising a drive unit generating a magnetic field oscillating at a predetermined frequency adapted to be positioned on the opposite side of the person, e.g. chest to back dimensions, and the measuring unit being adapted to measure the magnetic field strength, the system including calculating means for calculating the distance between the measuring unit and the drive unit.

15 Claims, 4 Drawing Sheets

(56) References Cited

U.S. PATENT DOCUMENTS

| | | | | |
|---|---|---|---|---|
| 6,780,017 | B2 * | 8/2004 | Pastrick et al. | 434/265 |
| 7,122,014 | B2 * | 10/2006 | Palazzolo et al. | 601/41 |
| 7,402,996 | B2 * | 7/2008 | Arai et al. | 324/207.17 |
| 7,476,206 | B2 * | 1/2009 | Palazzolo et al. | 601/41 |
| 8,175,691 | B2 * | 5/2012 | Huldt | A61B 5/04085 600/372 |
| 8,192,367 | B2 * | 6/2012 | Myklebust et al. | 600/538 |
| 2003/0030342 | A1 * | 2/2003 | Chen et al. | 310/102 R |
| 2004/0082888 | A1 * | 4/2004 | Palazzolo et al. | 601/41 |
| 2004/0133117 | A1 | 7/2004 | Eriksen et al. | |
| 2004/0210172 | A1 * | 10/2004 | Palazzolo et al. | 601/41 |
| 2004/0267325 | A1 | 12/2004 | Geheb et al. | |
| 2007/0027353 | A1 * | 2/2007 | Ghiron | A61N 2/02 600/9 |
| 2007/0054254 | A1 * | 3/2007 | Cook et al. | 434/262 |
| 2007/0276300 | A1 * | 11/2007 | Olson et al. | 601/41 |
| 2008/0149401 | A1 * | 6/2008 | Hagen et al. | 178/18.08 |
| 2010/0022904 | A1 * | 1/2010 | Centen | 600/534 |
| 2010/0228165 | A1 | 9/2010 | Centen | |
| 2010/0256539 | A1 * | 10/2010 | Strand et al. | 601/41 |

FOREIGN PATENT DOCUMENTS

| | | | |
|---|---|---|---|
| EP | 1491176 | A1 | 12/2004 |
| WO | WO-02/15836 | A2 | 2/2002 |
| WO | WO-2004/037154 | A2 | 5/2004 |
| WO | WO-2006/006871 | A2 | 1/2006 |
| WO | WO-2006/088373 | A1 | 8/2006 |
| WO | WO-2010/009531 | A1 | 1/2010 |

* cited by examiner

METHOD AND SYSTEM FOR MEASURING CHEST PARAMETERS, ESPECIALLY DURING CPR

This method relates to a system and method System for monitoring the position of a measuring unit when placed on a person, especially as part of a CPR measurement.

Quality of cardiopulmonary resuscitation (CPR), defined as chest compressions and ventilations, is essential for the outcome of cardiac arrest. Gallagher, Van Hoeyweghen and Wik, (Gallagher et al; JAMA 1995 Dec. 27; 274(24):1922-5. Van Hoeyweghen et al; Resuscitation 1993 Aug. 26(1):47-52; Wik L, et al Resuscitation" 1994; 28:195-203) respectively show that good quality CPR, performed by bystanders prior to the arrival of the ambulance personnel, can affect survival with a factor 3-4. But unfortunately, CPR is most often delivered with less than optimal quality, even by health care professionals according to a recent study published in JAMA (Wik et al. Quality of Cardiopulmonary Resuscitation During Out-of-Hospital Cardiac Arrest. Jama, Jan. 19, 2005-Vol 293, No 3). The most common failures are: Chest compressions are not delivered, ventilations are not delivered, chest compression depth is too shallow, chest compression rate is too high or too low, ventilation rate is too high or too low, or inflation time is too fast.

The 2005 international consensus on science, published in Resuscitation, volume 67, 2005 express in detail how CPR should be delivered in order to be effective, and how CPR and defibrillation should be used together. Chest compression guidelines are uniform for all adult and older child patients: Depth should be at least 4-5 cm, rate should be at least 100/min, and rescuers should release pressure fully between compressions. In reality however there are large individual differences between the necessary compressions depths and forces depending on such things as the size of the patient. Thus the guidelines may in some cases result in suboptimal treatment.

In EP1057451, Myklebust describe a sensor to measure chest compressions. This sensor is arranged with an accelerometer and a force activated switch. Part of the system is also means to estimate chest compression movement as a function of acceleration and signals from the force activated switch. One limitation by this sensor is that it does not provide means of reliably detecting that each chest compressions were completely released (limited by the sensitivity of the force switch). One further limitation of this technology is that the precision of the system depends on what surface the patient is lying on. For instance, when the patient is lying on a mattress, the sensor on top of the chest will measure both the movement of the patient on the mattress and the compression of the chest. Similar discussions are made in US2004/0210172 and in WO2006/006871 where accelerometers are used to monitor the movements of the bed. Until now this problem usually has been solved by adding a stiff plate beneath the patient, but even then there is evidence that much of the downward force applied leads to compression of the mattress as well as the chest, meaning that a single accelerometer on top of the chest will overestimate chest compression depth as it measures both the compression of the mattress and the chest. A solution to this problem is provided in US2004/267325 where two coils are used to measure the relative distance between them, a first of them transmitting a varying magnetic field that is picked up by the second coil on the opposite side of a patient. I problem related to this solution is that the transmitted magnetic field will vary to a great extent due to metallic objects in the surrounding. Adapted filtering is suggested in US2004/267325 but this will not provide sufficient signal quality under all situations thus reducing the accuracy of the measurements.

Thus it is an object of this invention to provide an accurate means for monitoring the compression of the chest of a patient relative to the back of the patient, especially during CPR, so as to provide information both about the compression depth and the dimensions of the chest, i.e. chest to back dimension, between the compressions, making it possible also to detect whether the pressure applied to the chest is completely released between the compressions. This object is obtained using as described above and characterized as stated in the independent claims.

The invention is based on detection of the strength of an oscillating magnetic field generated in a drive unit preferably positioned at the back of the patient, where the measuring unit is positioned on the chest. This way the measurements are made indifferent of the movements of the drive unit, so that even if the mattress is compressed during the CPR it does not affect the measurements. As the detection of magnetic field is a well know and fairly simple technology the measuring device may be simple, e.g. of the same size as the corresponding devices to be positioned on the chest of the patient described in the publications mentioned above comprising force sensors and/or accelerometers.

As the measured characteristic is the distance between the measuring unit positioned on the chest and the backboard at the back of the patient the system according to the invention also provides a means for measuring the chest dimensions in other situations than during compressions, and it also will system will also provide information about chest "molding" which means permanent change in chest-back dimension caused by chest collapse, for example due to mechanical stress from CPR.

The invention will be described in detail below with reference to the accompanying drawings, illustrating the invention by way of a number of examples.

FIG. 1*a* illustrates a drive unit and a measuring unit according to the invention positioned at a distance from each other.

FIG. 1*b* illustrates the measurement obtain at the measuring unit.

FIG. 2*a-d* illustrates alternative embodiments of the magnetic field generation.

Figure 1A:
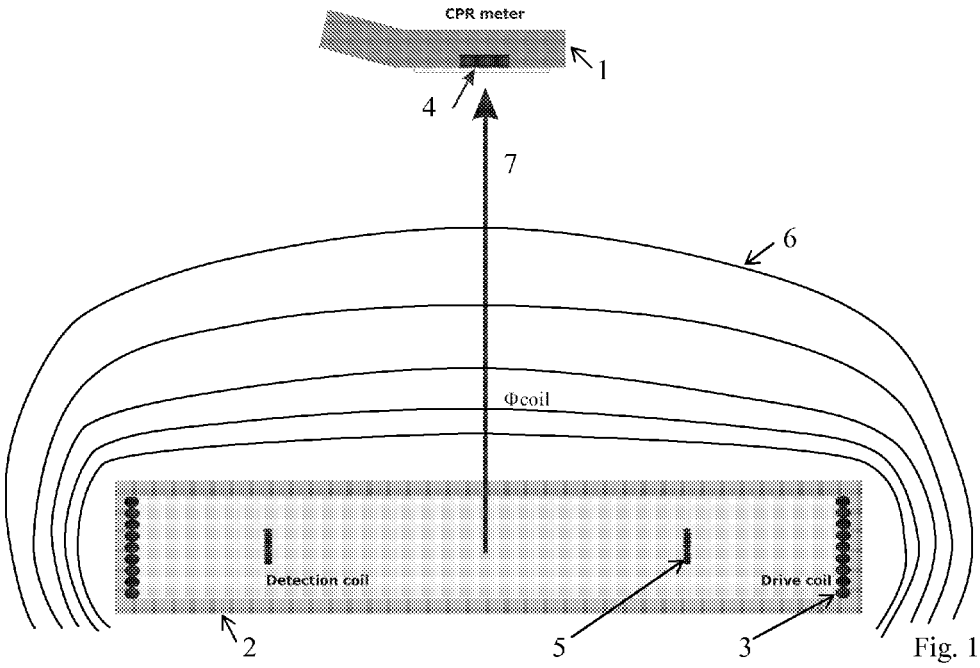

In FIG. 1*a* an embodiment of the invention is shown where a measuring unit 1 is positioned at a distance above a drive unit 2. The drive unit comprises a first drive coil 3 coupled to a power supply (not shown) for generating a magnetic field having a known field strength 6 varying with a predetermined frequency or within a predetermined frequency range, and at a known amplitude. The resulting magnetic field strength 6 will be dependent on the distance from the drive unit 2 and also on the positioned relative to the axis 7 of the magnetic field. As long as the measuring unit 1 is close to the field axis 7 the field strength 6 is dependent on the distance from the drive unit in a predictable way, as the characteristics of a generated magnetic field generated by a coil 3 are well known.

As the system is to be used on patients the frequency range of the varying magnetic field preferably should be in a range where the water in body of the patient does not affect the measurements significantly, and should thus be in the range of 50-100 kHz. Other ranges may be possible but will require calibration depending on the effect of the material affecting the magnetic field strength.

The drive unit 2 in FIG. 1*a* also comprises a secondary field sensor, illustrated as a coil 5, detecting the field strength at the drive unit. This enables the operator to compensate for losses in the field strength e.g. due to metallic structures close to the system, such as a metal bed frame. The operator may increase the field strength until the secondary drive coil detects the predetermined field strength, or this process may be performed automatically by a drive control system comparing the characteristics of the field measured at the sensor coil 5 with chosen values, e.g. maintaining the field strength in a chosen frequency range, corresponding to the chosen frequency range at the measuring unit 1, above a predetermined threshold being sufficient to provide accurate measurements at the measuring unit 1.

As may be seen from FIG. 1*a* the dimension of the drive coil 3 is chosen so as to be large, in the illustrated example comparable to the distance between the drive unit 2 and measuring unit 1. The exact size may vary with the application but it is advantageous if it is sufficiently large to make an essentially uniform magnetic field over the possible operating positions of the measuring unit. This way a displacement of the measuring unit 1 from the axis 7 of the magnetic field will have little effect of the measured field strength. This is evident from the illustrated field strength 6 which shows curves being essentially parallel to the drive coil 3 and thus the backboard, mattress or bed supporting the patient.

Figure 1B:
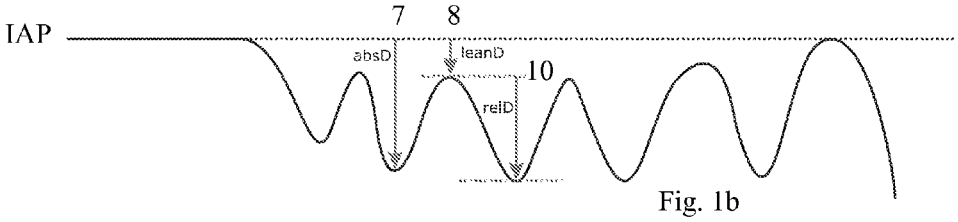

As is well known the measured field strength will depend on the distance from between the drive coil 2 and the measuring unit 1, and the resulting measurements is illustrated in FIG. 1*b* which shows typical waveforms from the sensor if, initially no force was applied to the sensor. The initial AP (IAP) represent the dimension of the chest before compression. Feedback based on the waveform with respect to the initial AP is indicated as 7, which indicates the depth relative to the initial position of the measuring instrument 1. When in used a so called "lean depth" 8 is introduced being the depth at which the measuring instrument 1 is positioned between the compressions, e.g. because the person performing the compressions has not completely released the compression force from the patient. The relative depth 8 is then the depth, ignoring the leaning depth, thus indicating the compression depth between maximum and minimum depth applied on the patient.

Figure 2A:
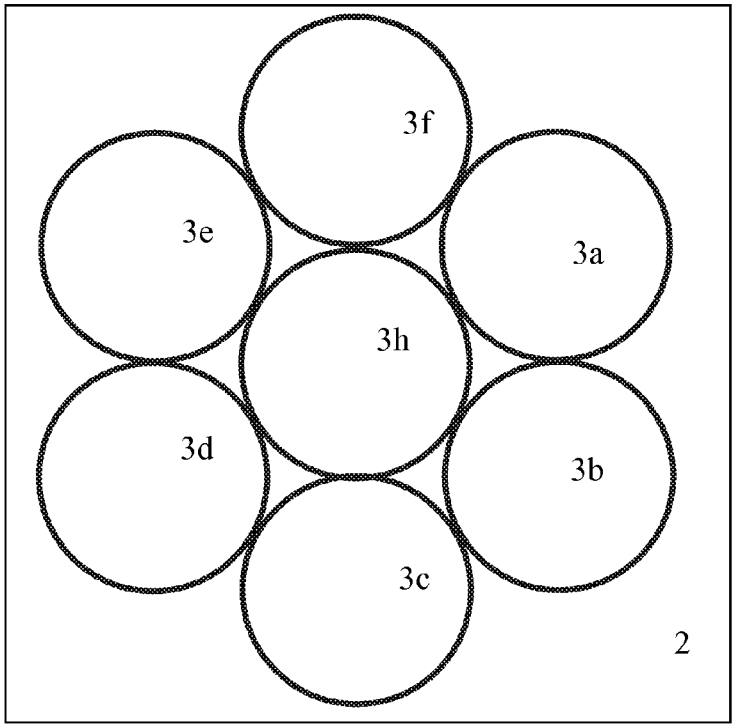
Figure 2B:
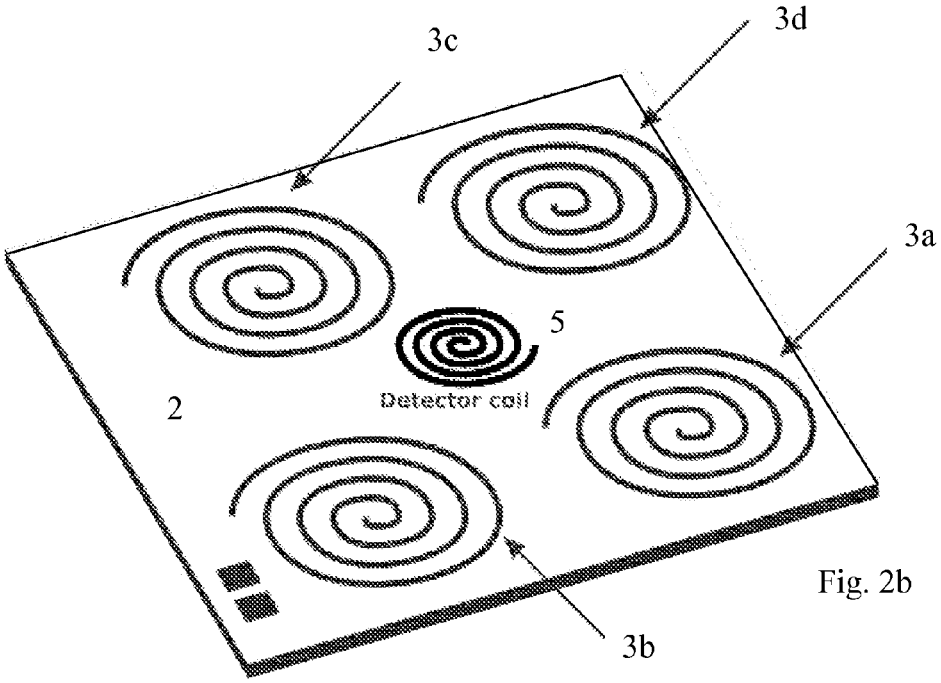

Other ways to obtain a uniform field within the working area of the measuring unit 1 are illustrated in FIGS. 2*a* and 2*b*. In FIG. 2*a* a number of coils 3*a*-3*h* are distributed over the backboard area, and may be synchronized to obtain an essentially uniform field. As in the previous embodiment a secondary coil 5 may be implemented in the backboard for measuring the local field in the backboard, e.g. for adjusting the field strength, either being constituted one of the coils 3*a*-3*h*, e.g. the middle coil 3*h*, or being provided as a separate and different coil 5*a* as illustrated in FIG. 2*b*.

In FIG. 2*b* the coils are provided on a printed circuit board as spirals so as to be made in a plane structure. The spiral shape is optional and may advantageously be made as coils which are not completely reaching into the centre of the spiral. In FIG. 2*b* a detector coil corresponding to the secondary coil in FIG. 1 is provided in order to adjust the magnetic field if subjected to metal structures etc.

In the examples shown in FIGS. 2*a* and 2*b* each individual coil may be driven at slightly different frequencies. If the measuring unit 1 is adapted to distinguish between the frequencies as well as measure the relative strength of the signal at each frequency it will be possible to calculate the position of the measuring unit in the measuring area as the closest coil will have the strongest field, etc. This may be advantageous for example for providing feedback to the user about the position of the measuring unit and thus where the CPR is performed in a patient.

Figure 2C:
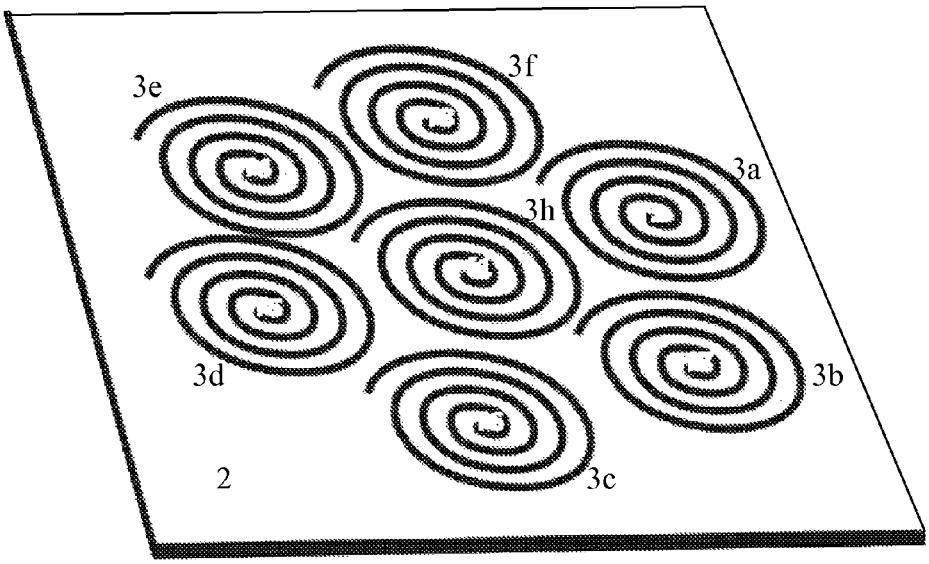
Figure 2D:
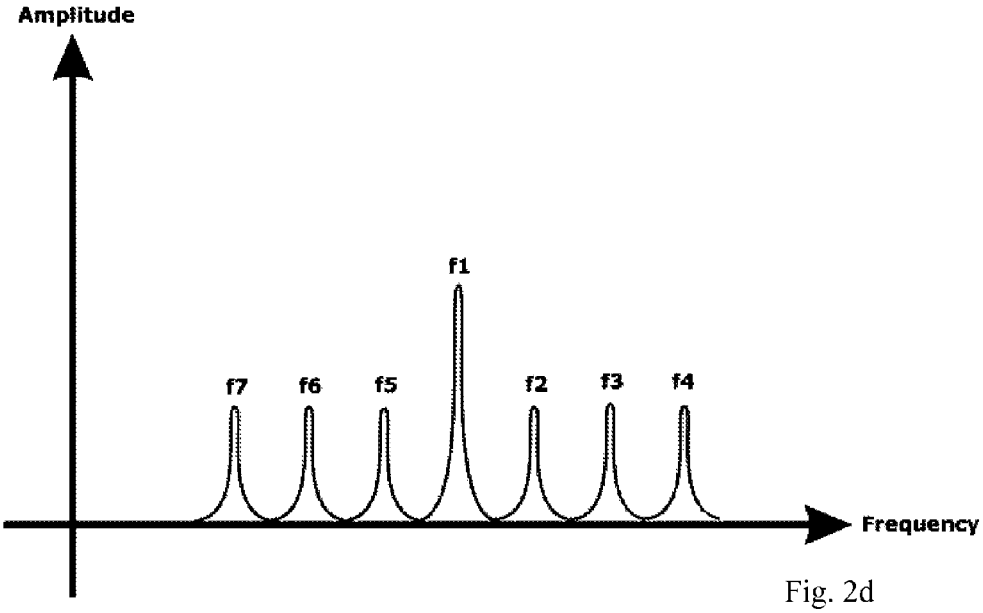

In FIG. 2*c* a solution corresponding to the backboard illustrates in FIG. 2*a* is shown being based on plane spiral coils. According to an alternative embodiment the coils may be adapted to apply magnetic fields oscillating at slightly different frequencies. The measuring instrument 1 may then measure the field strength or amplitude at each frequency and by detecting the frequency having the largest amplitude or field strength, this frequency indicating which of the coils being closest to the measuring unit, which again gives and indication of the position of the measuring unit relative to the backboard. FIG. 2*d* illustrates the distribution of amplitudes and frequencies in the case where the middle coil 3*h* emits the strongest frequency f1 and the distance between the measuring unit and the other coils are equal, thus indicating that the measuring unit is in the optimal position over the middle of the backboard.

Figure 3:
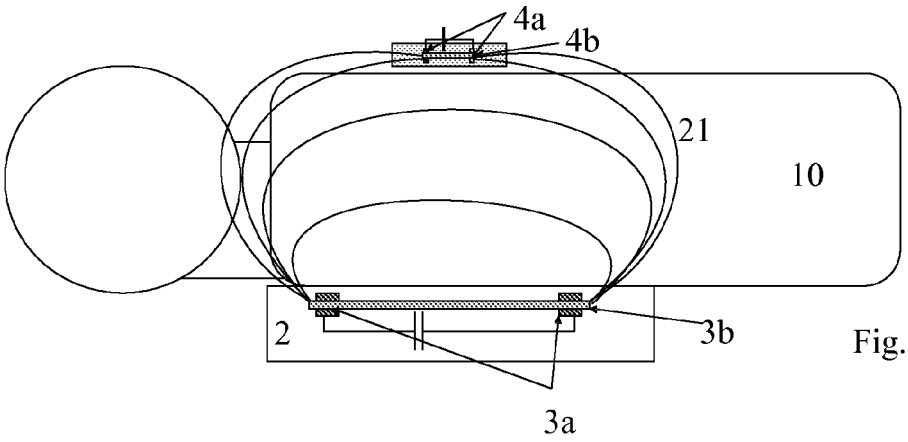
FIG. 3 illustrates an alternative embodiment of the system.

In the drawings discussed above the generated magnetic field has a direction 7 essentially perpendicular to the backboard 2 and in the direction from the backboard toward the working area of the measuring unit. In FIG. 3 an alternative embodiment is illustrated where a ferrite rod 3*b* magnetized being magnetized by coils 3*a* is provided generating a magnetic fielding the plane of the backboard and parallel to the bed and patient 10. A similar set is provided in the measuring unit 1 comprising a ferrite rod 4*b* and two coils 4*a* sensing the magnetic field. In FIG. 3 illustrated showing the field vector 21. In this case the measuring unit also has to be adapted to measure the field in the direction parallel to the ferrite rod. The field strength will have an essentially similar shape as illustrated in FIG. 1 in the illustrated direction having a circular cross section in the length of the patient if it is not perturbed by the bed or other conducting materials in the vicinity. Although not shown a properly oriented secondary field sensor 5 is also implemented in order to adjust the transmitted field strength.

Figure 4:
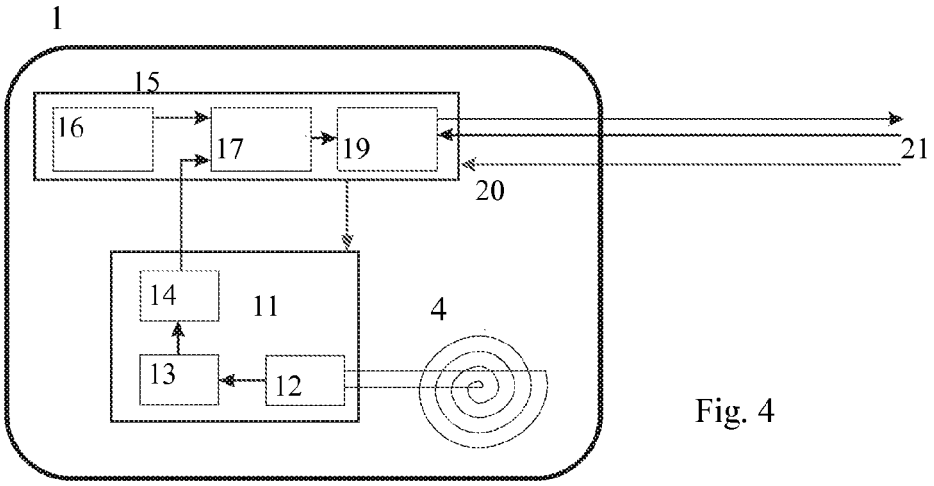
FIG. 4 illustrates the measuring unit.

The measuring unit is illustrated in FIG. 4 comprising a pickup coil 4 being sensitive to the magnetic field varying within the chosen frequency range. The coil is connected to an amplifier unit 11, in the illustrated embodiment comprising an amplifier 12, bandpass filter 13 and fullwave rectifier 14, the functions of which being well known to a person skilled in the art, and a sensor board 15, in the illustrated example containing an AD converter 17 and a microcontroller 19, transmitting the measured signal to the monitoring unit 21 controlling the system through a conductor lead. A digital signal processing unit may contemplated as an alternative. The conductor leads may be a serial connection and may also be used for receiving signals and/or power from the external instruments 21. The embodiment of the measuring unit in FIG. 4 also includes accelerometers 16 which may measure the orientation of the unit. This is advantageous as the measured amplitude of the magnetic field will depend on the orientation of the pickup coil relative to the magnetic field, as it measures the flux through the coil. This way the measured signal may be calibrated according to the orientation of the coil or a feedback signal may be provided so that the user may correct the position and orientation of the measuring unit.

Other means for measuring the magnetic field both in the measuring unit 1 and secondary field sensor 5 in the drive unit 2 may also be contemplated, such as Hall effect sensors, and as alternatives to the conductor transferring the measured signals other communication means may also be used such as optical or radio signals. In the case of a cordless communication system the measuring unit may be provided with a chargeable battery coupled to a battery charger or using a charging unit extracting energy from the magnetic field. It is also possible to transmit signals to the measuring unit through the generated magnetic field, for example by modulating the frequency and filtering the received signal at the measuring unit.

To summarize the invention relates to a system using an AC magnetic field for measuring of distance from back (board) to chest(sensor). The system is both capable of measuring both static distance (AP) and modulation (depth) using a frequency where no absorption in water is present.

As mentioned above the system according to the invention uses a secondary field sensor, e.g. a second coil, to minimize effect of metal and to stabilize the field strength by measuring the field. The secondary sensor is in the same position as the drive coil, e.g. in a backboard and coupled to means for adjusting the generated field so that the field strength in this position is at a suitable level. In addition to the discussions above this also provide a possibility for maintaining the field strength at a minimal value reducing any risks related to higher field strengths while maintaining sufficient strength to provide sufficient accuracy. A level less than 1.63 A/m, is considered a safe level at frequencies in the range of 100 kHz.

A metal plate may also be provided under the backboard drive coil in order to minimize effect of metal.

One or more accelerometers may be used in the in the measuring unit (and/or backboard) in order to compensate for "tilt" in one or more directions.

The system may use the magnetic AC field for communication between board and sensor by modulation of the field, or a radio communication between board and sensor for communication of various information such as board tilt, presence of metal, board operational status, etc.

In order to minimize the energy consumption of the system the drive coils is a resonance drive of the drive coil. Various coil solutions and methods may be chosen and in addition to the use of AC magnetic field acceleration sensors may also be used for measuring the movements of the measuring unit, i.e. the compression depth. In this case acceleration units may also be provided in the backboard to monitor the movements thereof.

The system includes monitoring instruments and software for obtaining information about the measured person or object, and analyzing the information. As discussed above, when used on a person the chest dimensions may be found and also the compression depth during CPR. This analysis may also be adapted to detect changes in the chest dimensions before and after the compressions, in order to detect whether the person performing compressions have released the pressure completely or whether the compressions have made more permanent changes in the chest, e.g. collapsing the chest.

The system may also be adapted to provide visual or acoustic feedback to the user based on the abovementioned analysis, e.g. by indicators on the measuring unit, sound effects or prerecorded voice messages. The measuring unit may be cordless communication by magnetic field or radio and being charged through the magnetic field or a charging receiver where it is positioned when not in use.

The invention claimed is:

1. A system comprising:

a measuring unit disposed on a chest of a person;

a drive unit including a drive coil generating a magnetic field oscillating at a predetermined frequency, the drive unit positioned on an opposite side of the person from the measuring unit, the drive unit comprising a secondary coil that measures a generated-field strength;

wherein the measuring unit is adapted to measure a magnetic field strength;

wherein a distance between the measuring unit and the drive unit is calculated as a function of magnetic field strength; and wherein a field strength generated by the drive unit is adjusted until the generated-field strength obtains a predetermined strength at the secondary coil thereby reducing influences of metal objects.

2. The system according to claim 1, wherein the drive unit is a backboard for positioning beneath a patient during CPR and the system being adapted to monitor a CPR compression depth based on a sequence of position measurements.

3. The system according to claim 2, wherein:

the CPR compression depth is compared with known recommended compression depths; and a response indicating quality of the compressions is generated.

4. The system according to claim 2, wherein the system is adapted to measure static distance between compressions.

5. The system according to claim 1, wherein the drive unit comprises a coil coupled to an AC current source.

6. The system according to claim 1, wherein a magnetic field variation is in a frequency range of 50-100 kHz thus avoiding absorption in water between the measuring unit and drive unit.

7. The system according to claim 6, wherein a drive frequency is a resonance frequency of the drive unit.

8. The system according to claim 1, wherein the measuring unit comprises an orientation measuring device measuring tilt relative to the magnetic field.

9. The system according to claim 8, wherein the orientation measuring device is an accelerometer.

10. The system according to claim 1, further comprising a communication unit for varying an amplitude of the magnetic field generated by the drive unit, the measuring unit being adapted to receive a communicated signal by detecting varying amplitude.

11. The system according to claim 1, wherein the measuring unit comprises a charging unit that extracts energy from said magnetic field and stores it in said measuring unit.

12. The system according to claim 1, wherein the measuring unit comprising a chargeable battery that is selectively coupled to a charger that charges the chargeable battery.

13. The system according to claim 1, wherein information of said distance before and after chest compressions is compared so as to detect chest collapse or molding.

14. Use of the system according to claim 1 for measuring a depth of the chest of the person by measuring the distance between the measuring unit and the drive unit.

15. The system according to claim 1, wherein the measuring unit is aligned with a vertical axis of the magnetic field generated by the drive unit.

* * * * *